United States Patent [19]

Bechtold

[11] 4,164,950

[45] Aug. 21, 1979

[54] SMOKING APPLIANCE

[76] Inventor: Joseph A. Bechtold, 1048 Homestead Rd., South Euclid, Ohio 44121

[21] Appl. No.: 866,790

[22] Filed: Jan. 3, 1978

[51] Int. Cl.[2] ..... A24F 1/22

[52] U.S. Cl. ..... 131/194; 131/173

[58] Field of Search ..... 131/173, 194, 195, 196, 131/200

[56] References Cited

U.S. PATENT DOCUMENTS

| | | | |
|---|---|---|---|
| 3,084,698 | 4/1963 | Smith | 131/194 |
| 3,506,018 | 4/1970 | Perino | 131/194 |
| 3,881,499 | 5/1975 | McFadden et al. | 131/173 |
| 4,036,240 | 7/1977 | Murry, Jr. | 131/173 |

*Primary Examiner*—Stephen C. Pellegrino

*Attorney, Agent, or Firm*—Burge & Porter Co.

[57] ABSTRACT

A smoking appliance utilizes a solid-phase cooling medium for tempering and treating smoke. The appliance has a housing which defines an upstanding cooling chamber. A burning bowl is arranged to introduce smoke to be treated into a lower portion of the cooling chamber. A flexible hose communicates a mouthpiece with the chamber for withdrawing treated smoke from an upper portion of the cooling chamber. A removable container is provided for supporting a solid-phase cooling medium within an intermediate portion of the cooling chamber. The cooling medium defines a plurality of flow paths for transmitting smoke from the lower portion to the upper portion. During its travel through the cooling medium, the smoke is exposed to a large surface area of the cooling medium to effect a thorough tempering and treating action. While the solid-phase cooling medium preferably takes the form of a reusable frozen cartridge, it may also constitute a plurality of pieces of ice supported within the container. A drainable residue collection area is provided at the base of the cooling chamber for catching ash particles and residue-containing liquid. A perforated wall is provided in the bottom of the container to restrain ash particles from coming into contact with the solid-phase cooling medium while, at the same time, permitting smoke to filter gently upwardly through the cooling medium.

13 Claims, 2 Drawing Figures

SMOKING APPLIANCE

BACKGROUND OF THE INVENTION

1. Field of the Invention

The present invention relates generally to smoking appliances and, more particularly, to a novel and improved smoking appliance which utilizes a solid-phase cooling medium for effectively tempering and treating smoke.

2. Prior Art

In the smoking of organic materials including some rare and expensive tobaccos, it is found that inhaled smoke oftentimes tends to be somewhat harsh, hot and irritating to the lungs of a smoker. Accordingly, it is desirable that the smoke from these materials be tempered and treated prior to its being inhaled. Devices known as "water pipes" and "bongs" have been used to effect tempering and treatment of smoke.

A water pipe ordinarily includes an upstanding housing which defines a water chamber near its base. A burning bowl is operably connected to the housing for introducing smoke into the water chamber. A mouthpiece communicates with the water chamber for drawing smoke from the burning bowl through the water chamber. As the smoke travels through the water, it tends to be cleaned of ash and certain other contaminants, and may be cooled slightly to render it more suitable for inhaling. In some instances, liquids other than water have been used in the water chamber. The use of wine has been proposed as a suitable water substitute.

A bong is ordinarily quite similar in construction to a water pipe, the principal difference being that the bong has no mouthpiece communicating with its water chamber but rather utilizes a housing having an open upper end which may be pressed against facial portions around the mouth of a smoker. As the smoker inhales, smoke from a burning bowl is drawn through water or other liquid disposed in a chamber at the lower end of the housing. A small diameter air admission hole may be formed through the wall of the housing at a level above that of the liquid. This hole may be maintained closed by a simple flap valve or may be held closed by the smoker during initial stages of a draw, whereupon the smoker may open the air admission hole toward the end of a draw to ease the draw as smoke from the chamber is inhaled.

While the adverse effects of harsh, hot and irritating smoke may be mitigated to a degree by proposed water pipe and bong appliances, the tempering and treating action they provide is not as thorough as many smokers desire. One reason for the relatively ineffective tempering and treating action provided by such appliances is that smoke being drawn through a liquid medium tends to travel through the medium in the form of a stream of rapidly moving bubbles. Only the outer surface areas of the rapidly moving bubbles are exposed to the liquid medium and the exposure time is quite minimal. While proposals have been made to increase exposure time by providing a relatively deep body of liquid filtering medium and/or by providing structure which defines relatively torturous paths for movement of smoke through the liquid medium, these proposals have been found to be relatively ineffective in improving the filtering and cooling actions and, in most instances, have significantly increased the draw strength required to effect passage of smoke through the cooling medium. Many proposed water pipe and bong appliances require unduly large draw strengths to effect proper operation.

A further disadvantage of many water pipe and bong appliance proposals has been that the liquid utilized as a cooling and filtering medium tends to become contaminated with ash particles within a relatively short period of time and must therefore be changed frequently. While proposals have been made to provide various types of ash collection chambers at locations which will prevent the entry of ash particles into the liquid cooling and filtering medium, most of these proposals have significantly increased the complexity, and hence the cost, of the resulting smoking appliances. Moreover, in many instances, these proposals have propounded the excessive draw strength problem and have rendered the appliances more difficult to clean.

The problem of providing a relatively simple and inexpensive smoking appliance which will provide a desirably effective cooling and filtering action, which will require minimal draw strength to operate, and yet which is easy to clean has continued to elude those skilled in the art.

SUMMARY OF THE INVENTION

The present invention overcomes the foregoing and other drawbacks of the prior art by providing a novel and improved, simple and inexpensive, easy to clean smoking appliance which employs a solid-phase cooling medium to effect a thorough tempering and treatment of smoke while requiring minimal draw strength to operate.

A smoking appliance embodying the preferred practice of the present invention is a self-contained unit, many of the components of which can be formed from relatively inexpensively molded plastics material. Components of the appliance include an upstanding housing having an open upper end which is closed by a removable cover. A cooling chamber is defined within the housing and a removable container is positionable within the cooling chamber for supporting a solid-phase cooling medium therein. A stem-supported burning bowl is provided for introducing smoke into a lower portion of the cooling chamber. A mouthpiece communicates with the cooling chamber through an opening formed in the cover for withdrawing smoke from an upper portion of the cooling chamber.

In preferred practice, a reusable frozen cartridge serves as the solid-phase cooling medium. The cartridge is receivable within the container and the container is configured to support the cooling medium at a location intermediate the lower and upper portions of the cooling chamber. Alternatively, pieces of ice may be supported within the container to serve as the solid-phase cooling medium. In either event, the solid-phase cooling medium defines a plurality of flow paths for the travel of smoke from the lower portion of the chamber to the upper portion of the chamber.

Several advantages obtain through the use of a solid-phase, rather than a liquid-phase, cooling and filtering medium. The medium defines a plurality of flow paths for the travel of smoke therethrough, whereby the smoke is exposed to a large surface area of the cooling and filtering medium to effect a far more thorough treating and tempering action than is effected where smoke passes in the form of rapidly moving bubbles through a liquid medium. The smoke is dispensed through a greater volume of cooling medium and, by virtue of the large volume of the medium and the large number of flow paths defined therethrough, the smoke can travel quite slowly and gently through the medium to significantly reduce its temperature and permit the condensation and/or settling out of contaminants. Moreover, since the smoke need not displace any portion of the medium as is required where smoke bubbles must force their way through a liquid medium, a thorough tempering and treating action can be had while, at the same time, providing an appliance which requires minimal draw strength.

Still another feature which obtains through the use of a solid-phase cooling medium is that the degree of treating and tempering action can be readily controlled. The extent to which smoke is cooled can be controlled by regulating the volume and/or temperature and/or torturous nature of the flow paths defined through the cooling medium. The degree to which smoke being treated is filtered can similarly be regulated by controlling the character of the flow paths through the cooling and filtering medium.

The use of a reusable frozen cartridge as the solid-phase cooling medium is preferred over the use of pieces of ice for several reasons. First, where ice is used as the solid-phase cooling medium, melt accumulates in the base of the appliance and must be periodically drained in order to prevent the appliance from operating in a water pipe mode. Moreover, where ice is used as the solid-phase cooling and filtering medium, the appliance tends to be more position sensitive than when used with a reusable frozen cartridge since the ice and the water which forms as the ice melts are both subject to spillage.

While a reusable frozen cartridge is preferred in most instances, there may be certain tobaccos which are found to be more effectively treated and tempered where ice is used as the solid-phase cooling medium. This may be due, at least in part, to the filtering and cleansing action which obtains as the smoke passes gently over the moisture laden surfaces of the pieces of ice. In such instances, the desirable filtering effects incurred by virtue of the exposure of the smoke to water is obtained without increasing the draw strength required to operate the appliance.

A smoking appliance constructed in accordance with the most preferred practice of the present invention includes an upstanding housing having a cylindrical side wall closed at its lower end by an orthogonally extending bottom wall. The side and bottom walls cooperate define an upwardly opening cooling chamber. A residue collection area is defined at the base of the cooling chamber. A drain opening is provided in the side wall of the housing for withdrawing residue-containing liquid from the residue collection area. A container supporting formation, preferably in the form of an annular, upwardly-facing shoulder is provided on the inside of the housing to support the cooling medium container at a location above the residue collection area. The container has a perforated bottom wall which functions to restrain ash particles from coming into contact with the solid-phase cooling medium while, at the same time, permitting smoke to filter gently upwardly through the cooling medium. The container has a side wall which slip-fits within the interior of the housing side wall and is provided with a handle to facilitate inserting and removing the cooling medium from the chamber. The housing and its cover are preferably formed from molded plastics material which have a relatively low heat transfer coefficient to minimize heat transfer therethrough, whereby the effective life of the solid-phase cooling medium can be prolonged. The stem of the burning bowl extends through an opening formed in the housing side wall and can be removed therefrom for cleaning and storage. When the appliance is to be stored or transported, the stem-supported burning bowl and the mouthpiece can be inserted within the cooling chamber to minimize the size of the appliance and to protectively enclose its operating components.

As will be apparent from the foregoing summary, it is an object of the present invention to provide a novel and improved smoking appliance.

It is a further object of the present invention to provide a novel and improved smoking appliance which utilizes a solid-phase cooling medium to effect a thorough and controlled tempering and treatment of smoke.

It is a further object of the present invention to provide a novel and improved smoking appliance provided with a container for supporting and removably positioning a solid-phase cooling medium within the housing of the appliance.

It is a further object of the present invention to provide a novel and improved smoking appliance which can utilize any of a plurality of selected solid-phase cooling media for tempering and treating smoke.

It is a further object of the present invention to provide a novel and improved smoking appliance including a reusable frozen cartridge as a solid-phase cooling and filtering medium for tempering and treating smoke.

It is still another object of the present invention to provide a novel and improved smoking appliance adapted to utilize pieces of ice as a solid-phase cooling medium and providing a catch chamber below the medium for receiving condensate liquid at a location which will not require the passage of smoke through the condensate.

These and other objects and a fuller understanding of the invention described and claimed in the present application may be had by referring to the following description and claims taken in conjunction with the accompanying drawing.

DESCRIPTION OF THE PREFERRED EMBODIMENT

Figure 1:
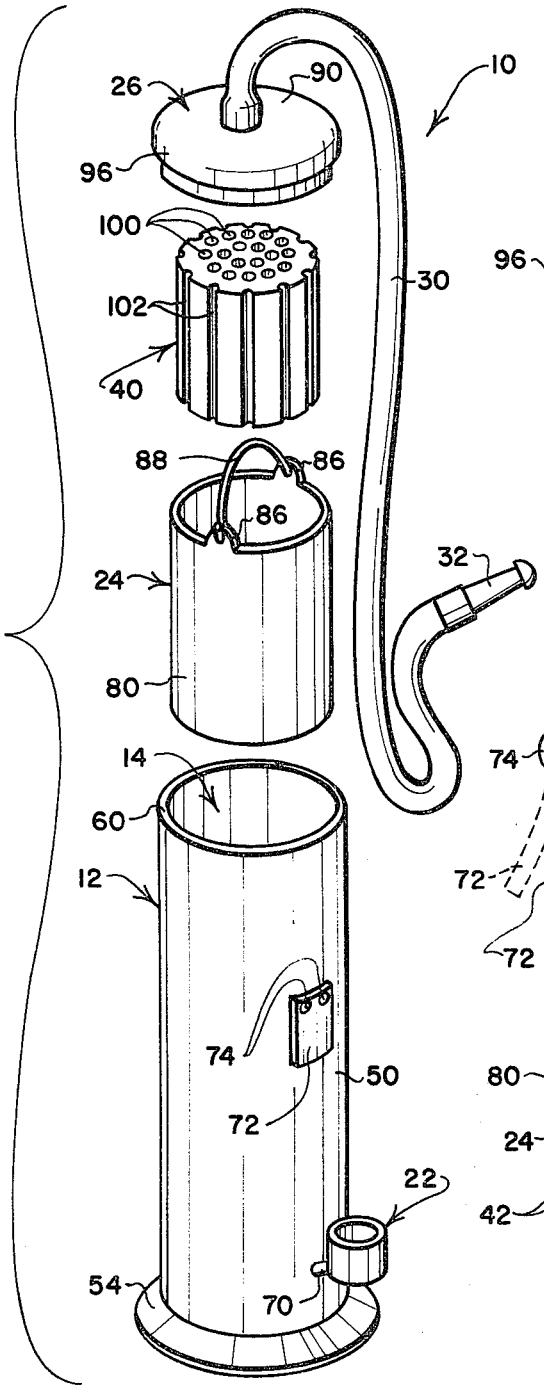
FIG. 1 is an exploded perspective view of a smoking appliance embodying the preferred practice of the present invention and illustrating a reusable frozen cartridge which may be employed in the smoking appliance as a solid-phase cooling medium; and, FIG. 2 is an enlarged sectional view of a portion of the appliance of FIG. 1 with pieces of ice being used in place of the cartridge as a solid-phase cooling medium.
Figure 2:
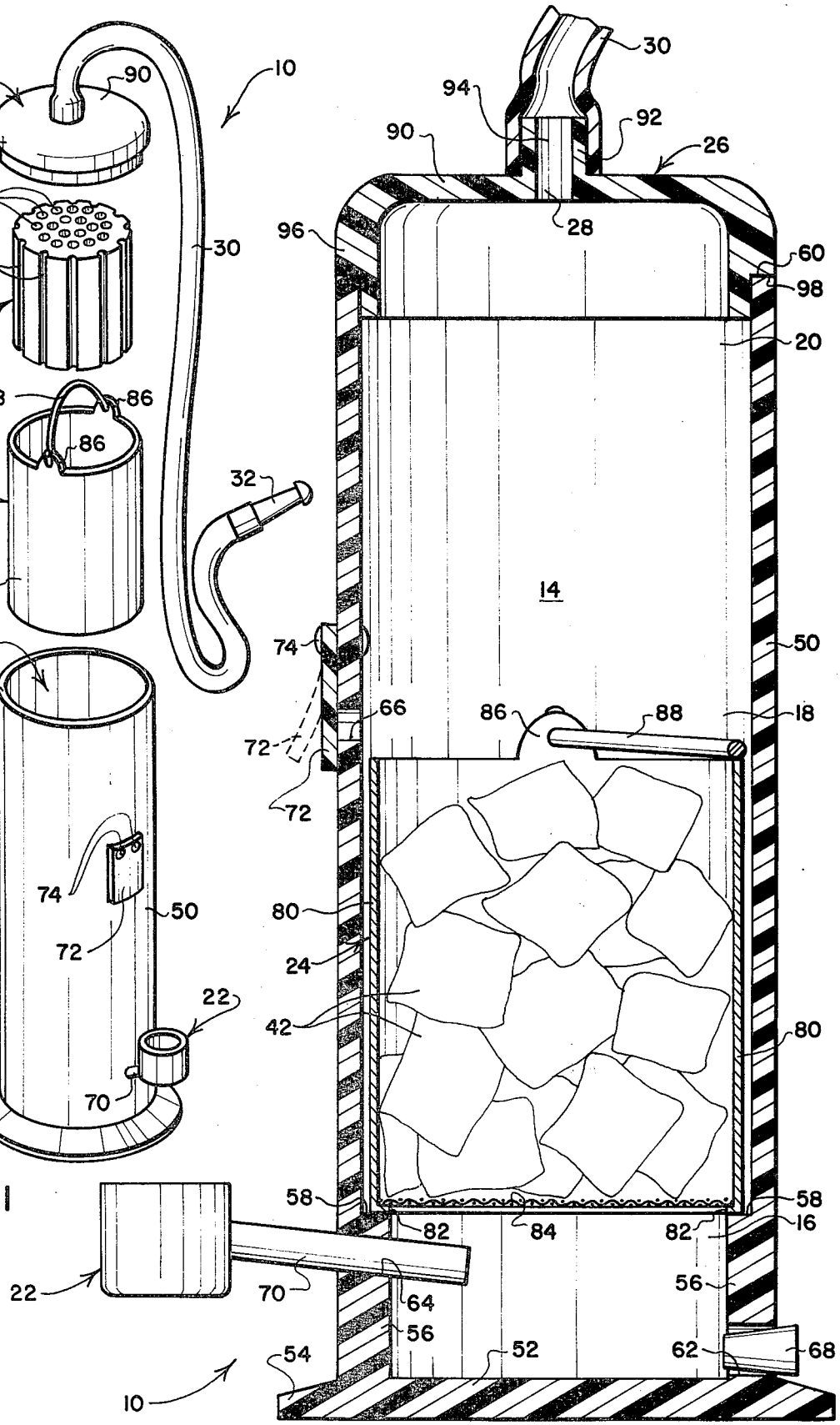

Referring to FIGS. 1 and 2, a smoking appliance embodying the preferred practice of the present invention is indicated generally by the numeral 10. The appliance 10 includes a housing 12 which defines an upwardly opening cooling chamber 14. While the cooling chamber 14 is not physically subdivided, for purposes of discussion it may be considered to have lower, intermediate and upper portions, as indicated in FIG. 2 by the numerals 16, 18, 20.

A conventional stem-supported burning bowl 22 communicates with the cooling chamber 14 for introducing smoke to be treated into the lower portion 16. A bucket-like container 24 is provided for supporting a solid-phase cooling medium within the intermediate portion 18. A cover 26 is provided for closing the open upper end of the housing 12 and is provided with an opening 28 for withdrawing smoke from the upper portion 20. A flexible hose 30 communicates the withdrawal opening 28 with a mouthpiece 32.

In FIG. 1, the solid-phase cooling medium takes the form of a reusable frozen cartridge 40. The cartridge 40 is of substantially right cylindrical configuration and is positionable in a slip-fit within the container 24. In FIG. 2, the solid-phase cooling medium takes the form of pieces of ice 42, preferably ice cubes, supported within the container 24. In either event, the solid-phase cooling medium 40, 42 functions to provide a relatively large volume cooling medium having a plurality of elongate flow paths formed therethrough for guiding the travel of smoke from the lower portion 16 to the upper portion 20. A feature of the solid-phase cooling medium is that its flow paths offer relatively little resistance to the travel of smoke whereby the draw strength required to operate the appliance 10 is minimized. Moreover, in view of the multiplicity of flow paths and their relatively non-constricted character, smoke tends to travel relatively slowly and gently through the solid-phase cooling medium, whereby it is subjected to an extensive and effective tempering and treating action to relieve its otherwise hot, harsh and irritating character.

Turning now to the more specific details of construction of the components of the appliance 10, the housing 12 has a tubular, substantially cylindrical upstanding side wall 50 which is closed at its lower end by an integrally formed base wall 52. The base wall 52 has an outer flange portion 54 which extends circumferentially around the base of the side wall 50 to provide a stable support for the appliance 10.

Referring to FIG. 2, the upstanding side wall 50 has a lower portion 56 which is approximately twice as thick as other portions of the side wall 50. An annular, upwardly facing shoulder 58 is provided at the upper end of the lower wall portion 56. The upper end of the side wall 50 defines a substantially planar rim surface 60.

Three openings, 62, 64, 66, are provided through the side wall 50. The opening 62 communicates with the lower chamber portion 16 adjacent the base wall 52 and provides a means for draining liquid from the lower chamber portion 16. A conventional resilient stopper 68 is provided for closing the opening 62. The opening 64 is adapted to receive the stem 70 of the burning bowl 22. The opening 64 is configured to snugly receive the stem 70 whereby the burning bowl 22 is supported on the housing 12. The fit which obtains between the stem 70 and such portions of the housing 12 as surround the opening 64 is designed such that the stem 70 can be withdrawn from the opening 64 to permit the burning bowl to be stored within the cooling chamber 14 when the appliance 10 is not in use. The opening 66 is normally closed by a resilient flap 72. The flap 72 is secured to the outer surface of the side wall 50 by a pair of rivets 74. During operation of the appliance 10, a smoker may deflect the flap 72, as indicated in phantom in FIG. 2, to permit the introduction of ambient air into the chamber 14 to provide a suitable mix of air with treated smoke.

The container 24 may be formed from metal or suitable plastics material and includes a generally cylindrical upstanding side wall 80 having an integrally formed, inwardly turned flange portion 82 at its base. A perforated bottom wall, preferably in the form of a woven screen 84, rests atop the inwardly turned flange 82. A pair of upwardly extending tabs 86 are formed integrally with the side wall 80 and are provided with holes which receive opposite ends of a handle 88. As will be apparent from a comparison of FIGS. 1 and 2, the handle 88 is pivotally connected to the tabs 86 for movement between upstanding and storage positions.

The cover 26 has a generally cylindrical top wall 90 with a centrally located upstanding projection 92. The withdrawal opening 28 constitutes the lower end of a hole 94 formed through the upstanding projection 92. The cover 26 has a depending circumferentially extending wall 96 with a downwardly facing shoulder 98 configured to rest atop the housing rim 60.

The hose 30 is preferably formed from a suitable resilient material and has one end stretched over the upstanding formation 92 to communicate the hose 30 with the hole 94. The mouthpiece 32 can be of any suitable conventional configuration.

While the appliance 10 preferably includes the cover 26, the hose 30 and the mouthpiece 32, these components are not essential to its operation and can be eliminated where the smoker desires to use the appliance 10 in the manner of a bong, i.e., by positioning facial portions surrounding his mouth in engagement with the rim surface 60 during a draw. It is preferred to use the cover 26, hose 30 and mouthpiece 32 because these components permit the appliance 10 to be used without grasping and/or moving the housing 12. Where the appliance 10 is used as a bong, a plain cover (not shown) is preferably used to close the cooling chamber 14 between draws to prolong the effective life of the solid-phase cooling medium supported in the container 24.

The reusable frozen cartridge 40 is provided with a plurality of circular passages 100 formed through its core and extending from its upper end to its lower end. A plurality of circumferentially spaced grooves 102 are formed in the outer wall of the cartridge and extend from its upper end to its lower end. When the cartridge 40 is positioned in the container 24, the passages 100 and the grooves 102 are communicated by the perforated screen 84 with the lower chamber portion 16. The side wall 80 of the container 24 cooperates with the grooves 102 to define a plurality of passages along which smoke may travel as it moves from the lower chamber portion 16 toward the upper chamber portion 20. The passages 100 also define a plurality of flow paths for smoke as it travels from the lower chamber portion 16 toward the upper portion 20.

As will be apparent to those skilled in the art, reusable frozen cartridges having a variety of other configurations can be used. Cartridges suitable for use with the present invention preferably employ a semi-permanent refrigerant supported in a sealed container and being adapted to be repeatedly frozen and thawed. Cartridges of this type are well-known to those skilled in the art as exemplified, for instance, by such teachings as are found in U.S. Pat. Nos. 2,800,454; 2,800,455; and 2,803,115, the disclosures of which are incorporated herein by reference. Accordingly, the construction and arrangement of such cartridges need not be further described.

In operation, the appliance 10 is prepared for use by inserting either the frozen cartridge 40 or a plurality of pieces of ice 42 or some other suitable solid-phase cooling medium into the container 24, whereafter the container 24 is inserted into the cooling chamber 14 to a position where its in-turned flange 82 rests atop the housing flange 58, as shown in FIG. 2. The cover 26 is then positioned atop the housing 12, as shown in FIG. 2, and the organic material to be smoked is loaded into the burning bowl 22 and ignited. If ice or some other meltable solid-phase cooling medium is used, it may be necessary to periodically remove the drain plug 68 from the hole 62 to drain condensate liquids from the lower portion 16 of the chamber 14. As smoke is drawn through the hose 30 by drawing on the mouthpiece 32, the flap valve 72 may be opened by the smoker as desired to admit ambient air into the cooling chamber 14 through the opening 66 to provide a desired mixture of air and treated smoke.

While the cartridge 40 may be configured to have an outer diameter which will permit its resting on the upwardly facing housing shoulder 58 thereby obviating the need for positioning the cartridge 40 in the container 24, it is nonetheless preferred to utilize the container 24 to support the cartridge 40 because the container's perforated bottom wall screen 84 acts to restrain the passage of ash particles into the cooling medium passages and grooves 200, 202. Accordingly, the container 24 not only acts as a means for facilitating the insertion and removal of the cartridge 40 from the chamber 14, but also acts in the capacity of a screening device to prevent the entry of some contaminants into the cooling and filtering medium 40, 42.

As will be apparent from the foregoing description, the present invention provides a novel and improved, simple and inexpensive smoking appliance which utilizes a solid-phase cooling medium in a manner which overcomes many drawbacks of previous proposals. Smoking appliances embodying the preferred practice of the present invention are easy to operate, easy to clean, and require minimal draw strength to effect passage of smoke through the cooling medium. Smoking appliances embodying the preferred practice of the present invention can be used with a variety of solid-phase cooling media and, for that matter, can also be used without a solid-phase cooling medium in the manner of conventional water pipes and bongs.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A smoking appliance comprising:

(a) housing means including structure defining a cooling chamber;

(b) smoke introduction means for introducing smoke into the cooling chamber at a first location therein;

(c) smoke withdrawal means for withdrawing smoke from the cooling chamber at a second location spaced from the first location; and, (d) solid-phase cooling medium means including a sealed, reusable, freezable cartridge for positioning in the cooling chamber and for defining a plurality of flow paths therethrough for the travel of smoke as smoke moves from the first location to the second location during use of the appliance.

2. The smoking appliance of claim 1, wherein:

(a) the housing means defines a cooling chamber of elongate, upstanding configuration;

(b) the first location is near the lower end of the cooling chamber;

(c) the second location is near the upper end of the cooling chamber; and, (d) the appliance includes support means for positioning the cooling medium means between the first and the second locations.

3. The smoking appliance of claim 2 wherein the support means includes a container for receiving the cooling medium means and for facilitating its insertion into and withdrawal from the cooling chamber.

4. The smoking appliance of claim 3 wherein the cartridge has upper and lower ends and defines a plurality of flow paths between its upper and lower ends, and the cartridge is positionable in the container with its lower end communicating with the lower end region of the cooling chamber and with its upper end communicating with the upper end region of the cooling chamber.

5. A smoking appliance comprising:

(a) housing means including structure defining a cooling chamber;

(b) smoke introduction means for introducing smoke into the cooling chamber;

(c) smoke withdrawal means for withdrawing smoke from the cooling chamber;

(d) solid-phase cooling medium means including a sealed, reusable, freezable cartridge defining a plurality of flow paths therethrough for the travel of smoke as smoke moves through the cooling chamber from the vicinity of the smoke introduction means to the vicinity of the smoke withdrawal means; and, (e) support means for supporting the solid-phase cooling medium means within the cooling chamber for cooling smoke as it passes through the chamber from the smoke introduction means to the smoke withdrawal means.

6. The smoking appliance of claim 3 wherein the container has a perforated bottom wall which is operable to restrain ash particles from coming into contact with the cooling medium means.

7. The smoking appliance of claim 5 wherein the smoke introduction means and the smoke withdrawal means communicate with the cooling chamber at spaced locations therein, and the support means includes a container operable to support the cooling medium at a position between the spaced locations.

8. A smoking appliance comprising:

(a) housing means including structure defining a cooling chamber;

(b) smoke introduction means for introducing smoke into the cooling chamber;

(c) smoke withdrawal means for withdrawing smoke from the cooling chamber;

(d) support means for supporting a solid-phase cooling medium within the cooling chamber for cooling smoke as it passes through the chamber from the smoke introduction means to the smoke withdrawal means;

(e) the smoke introduction means and the smoke withdrawal means communicating with the cooling chamber at spaced locations therein;

(f) the support means including a container operable to support the cooling medium at a position between the spaced locations; and, (g) formation means on the interior of the housing means for engaging the container to position the cooling medium at a location between the upper and lower end regions of the cooling chamber.

9. A smoking appliance comprising:

(a) housing means including structure defining a cooling chamber;

(b) smoke introduction means for introducing smoke into the cooling chamber;

(c) smoke withdrawal means for withdrawing smoke from the cooling chamber;

(d) support means for supporting a solid-phase cooling medium within the cooling chamber for cooling smoke as it passes through the chamber from the smoke introduction means to the smoke withdrawal means;

(e) the smoke introduction means and the smoke withdrawal means communicating with the cooling chamber at spaced locations therein;

(f) the support means including a container operable to support the cooling medium at a position between the spaced locations; and, (g) the container having side wall portions which cooperate with the cooling medium to define a plurality of flow paths for the smoke as it travels through the cooling medium from the smoke introduction means to the smoke withdrawal means.

10. A smoking appliance comprising:

(a) housing means including structure defining a cooling chamber;

(b) smoke introduction means for introducing smoke into the cooling chamber;

(c) smoke withdrawal means for withdrawing smoke from the cooling chamber;

(d) support means for supporting a solid-phase cooling medium within the cooling chamber for cooling smoke as it passes through the chamber from the smoke introduction means to the smoke withdrawal means;

(e) the smoke introduction means and the smoke withdrawal means communicating with the cooling chamber at spaced locations therein;

(f) the support means including a contianer operable to support the cooling medium at a position between the spaced locations; and, (g) the support means including container means for receiving and supporting the cooling medium, the container means having a perforated bottom wall which is operative to restrain ash particles from coming into contact with the cooling medium.

11. A smoking appliance, comprising:

(a) housing means including structure defining a cooling chamber;

(b) smoke introduction means for introducing smoke into the cooling chamber at a first location therein;

(c) smoke withdrawal means for withdrawing smoke from the cooling chamber at a second location spaced from the first location;

(d) support means for supporting a solid-phase cooling medium means in the form of pieces of ice in the cooling chamber at a position between the first and second locations for defining a plurality of flow paths therethrough for the travel of smoke as the smoke moves from the first location to the second location during use of the appliance; and, (e) the smoke introduction means, the smoke withdrawal means, and the support means being arranged such that the first location is near but spaced above the lower end of the cooling chamber, and the cooling chamber is provided with means for withdrawing therefrom such water as may tend to collect in the lower end of the cooling chamber due to melting of the pieces of ice so that the level of water which may tend to collect in the lower end of the cooling chamber need not rise to the level of the first location.

12. The smoking appliance of claim 11 wherein the support means includes a container for receiving the pieces of ice and for facilitating their insertion into and withdrawal from the cooling chamber.

13. The smoking appliance of claim 12 wherein the container has a perforated bottom wall which is operable to restrain ash particles from coming into contact with the cooling medium means.

* * * * *